US009542921B2

(12) United States Patent
Wardlow

(10) Patent No.: US 9,542,921 B2
(45) Date of Patent: Jan. 10, 2017

(54) MANUALLY ADVANCED SEQUENCER

(71) Applicant: William Glenn Wardlow, Sunriver, OR (US)

(72) Inventor: William Glenn Wardlow, Sunriver, OR (US)

( * ) Notice: Subject to any disclaimer, the term of this patent is extended or adjusted under 35 U.S.C. 154(b) by 0 days.

(21) Appl. No.: 14/712,050

(22) Filed: May 14, 2015

(65) Prior Publication Data

US 2016/0335996 A1 Nov. 17, 2016

(51) Int. Cl.
*G10H 1/00* (2006.01)
*G10H 1/36* (2006.01)

(52) U.S. Cl.
CPC ..... *G10H 1/36* (2013.01); *G10H 1/0066* (2013.01); *G10H 2210/005* (2013.01); *G10H 2220/341* (2013.01)

(58) Field of Classification Search
CPC ..... G10H 1/0066; G10H 2220/341
USPC ..... 84/645, 721, 746
See application file for complete search history.

(56) References Cited

U.S. PATENT DOCUMENTS 4,022,097 A * 5/1977 Strangio ..... G10G 1/00 84/337
4,206,676 A * 6/1980 Adachi ..... G10H 1/20 84/672
5,085,117 A * 2/1992 Morokuma ..... G10H 1/18 84/615
5,115,705 A * 5/1992 Monte ..... G10H 1/182 338/69
5,565,641 A * 10/1996 Gruenbaum ..... G10H 1/0066 84/451
5,700,966 A * 12/1997 LaMarra ..... G10H 1/0066 84/645
6,103,964 A * 8/2000 Kay ..... G10H 1/02 84/611
6,121,532 A * 9/2000 Kay ..... G10H 1/00 84/445
6,121,533 A * 9/2000 Kay ..... G10H 1/0091 84/616
6,365,814 B1 * 4/2002 Matsuda ..... G10H 1/0008 84/470 R
2007/0089590 A1 * 4/2007 Katou ..... G09B 15/08 84/609
2015/0046824 A1 * 2/2015 Humphrey ..... G06F 3/0481 715/727
2015/0161978 A1 * 6/2015 Packouz ..... G10H 1/40 84/746

* cited by examiner

*Primary Examiner* — David Warren

(57) ABSTRACT

An improved method of manually advancing through Steps in a Sequence using an electromechanical momentary switch, an electronic device capable of detecting changes in the state of said electromechanical momentary switch, and a Sequencer, whereby said electronic device will, upon detecting each change of state in said electromechanical momentary switch, trigger said Sequencer to advance to a next Step in a Sequence and recall a Data Set associated with said Step.

18 Claims, 1 Drawing Sheet

MANUALLY ADVANCED SEQUENCER

This REVISED application is related to Patent Application No. 14/712,050.

DEFINED TERMS

This application uses the following defined terms:

Data Set—a group of one or more values that can be electronically stored and recalled Sequence—a series of Data Sets that exist in a predetermined order Step—the basic unit of a Sequence consisting of a discrete Data Set Sequencer—a programmable electronic device that can store a Sequence, and upon the occurrence of a triggering event, advance through each Step of said Sequence and recall the Data Set associated with said Step

BACKGROUND

This application relates to manually advanced Sequencers, and an improved method of advancing through Steps in a Sequence.

Sequencers are most commonly under the control of an automated external timing source, such that the Sequence continually loops through the Steps at a rate determined by the timing source.

Automatic control of a Sequence is, however, not always desirable, and there exist methods of manually advancing through Sequencer Steps.

Current manual Sequencer Step advancement commonly takes the form of a triggering event via the pressing or releasing of an electromechanical momentary switch.

The present invention takes advantage of both discrete states of an electromechanical momentary switch and advances a Sequencer to a next Step in a Sequence upon each change of state (upon a press and again upon release).

The improvements provided by the -present invention are that it allows a far more efficient, intuitive, natural, and rhythmically flexible method of advancing a Sequencer, and requires 50% less motion while providing twice the speed of existing methods of manually advancing Sequencers using electromechanical momentary switches.

Musicians often use Sequencers to play a pre-programmed series of musical notes and/or to sequentially apply special effects to an audio signal. The present invention is particularly helpful in the context of a musical performance where the music is being played live and a musician wishes to synchronize his or her Sequencer with the sounds created by the other human accompanists whose timing is inherently variable. The ability to manually advance a Sequence in such an efficient and natural manner makes it simple for said musician to adjust to a shifting and dynamic tempo.

DRAWINGS

Figure 1:
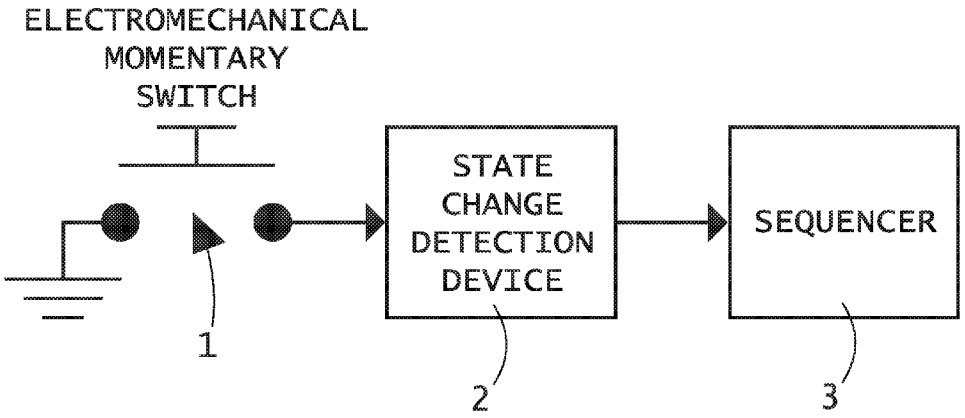

FIG. 1 illustrates an electromechanical momentary switch 1, any change in the state of which is detected by a state change detection device 2, which, upon detecting such state change, triggers a Sequencer 3, to advance to a next Step in a Sequence and recall a Data Set associated with said Step. Note that said electromechanical momentary switch need not necessarily be connected to electronic ground.

Figure 2:
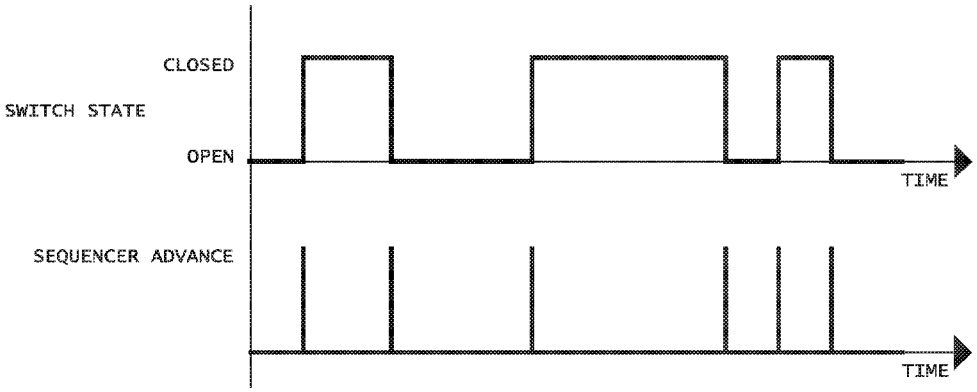

FIG. 2 illustrates the relationship between the state of an electromechanical momentary switch and Sequencer advancement, whereby each change in the state of said electromechanical momentary switch causes said Sequencer to advance.

DETAILED DESCRIPTION—INITIAL COMMERCIAL EMBODIMENT

The Initial Commercial Embodiment of the present invention uses a spring-loaded normally-open single-throw momentary contact electromechanical footswitch (hereinafter "Momentary Footswitch"). A normally closed momentary footswitch is equally suitable for purposes of the Initial Commercial Embodiment.

One terminal of said Momentary Footswitch is connected to electrical ground and the other terminal is interfaced with an input pin on a pre-programmed General Purpose Data Processor Of A Known Type (hereinafter "Processor")

Because the contacts on said Momentary Footswitch physically bounce when they change states, an electrical circuit which filters out switch bounce exists between said Momentary Footswitch and the input pin on said Processor.

When said Momentary Footswitch is open, said input pin is high (positive voltage). When said Momentary Footswitch is closed, said input pin is grounded.

Said Processor periodically reads said input pin voltage and turns the reading into a binary value (0 for ground, 1 for positive voltage). Said binary value is a numerical representation of the state of said Momentary Footswitch.

Said Processor is capable of detecting the open and closed state of said Momentary Footswitch, storing that state in memory, and detecting each change in the state of said Momentary Footswitch by comparing the current state to the state stored in memory.

During normal operation, said Processor periodically checks the state of said Momentary Footswitch and compares it to the state stored in memory. If the current state of said Momentary Footswitch has changed from the state stored in memory, the Processor: 1) stores the new state of said Momentary Footswitch in memory; 2) advances to the next Step in the Sequence and recalls the Data Set associated with said Step. These two steps need not happen in any particular order.

Many Step Sequencers utilize a discrete number of Steps which are played back in a loop, such that when a Sequence is advanced from its final Step, the Sequencer restarts at the first Step in the Sequence. The Initial Commercial Embodiment uses this type of system.

In the Initial Commercial Embodiment, said Processor stores sequences of data values in its memory. The data values corresponding to each Step, and number of Steps in the Sequences are programmable by the user (although initial values may be pre-assigned during manufacturing).

The data values corresponding to the Sequence Steps in the Initial Commercial Embodiment are output using the MIDI (Musical Instrument Digital Interface) format and are sent to audio effects which read MIDI data and react predictably thereto.

The Initial Commercial Embodiment is programmed to interface with, among other things, audio effect devices that shift the pitch of electronic audio signals (said signals have been converted to digital audio data) in response to MIDI data. In this way, a musician is able to play a single note on an electronic musical instrument, such as an electric guitar, and use said Momentary Footswitch to smoothly and rhythmically advance through a Sequence of shifted pitches, making it sound as though said musician is playing a series of notes rather than a single note.

Unlike existing manually advanced Sequencers, a musician need not press and release a momentary switch to manually advance a single Sequence Step, but is instead able to advance the Sequence each time a momentary switch changes states (upon press and again upon release), which is a far more intuitive, natural, and rhythmic method of advancing a Step Sequencer, and one which requires 50% less motion while providing twice the speed of existing methods of manually advancing Step Sequencers using momentary switches.

ALTERNATE FEATURES/EMBODIMENTS

Switch Bounce

The Processor used in the Initial Commercial Embodiment is programmed to ignore switch state changes that result from switch bounce.

Although the Initial Commercial Embodiment uses both electronic circuitry and additional lines of program code to eliminate the effects of switch bounce, it should be noted that there exist other types of switches which do not suffer from switch bounce, such as optical interrupter switches, and which may not require said additional electronic circuitry and/or lines of code.

Switch Types

Potential embodiments of the present invention include, but are in no way limited to, those using the following alternate types of switches and switch interfaces:

Optical sensor
Optical interrupter
Proximity sensor
Variable Resistance

The key factors are that the switch has at least two distinct states, can be physically actuated, and is momentary in nature (it returns to its previous state when not being actuated).

Interrupt on Change

Many microcontrollers and computer chips are able to generate a program interrupt when the state of an input pin is changed. Potential embodiments of the present invention may wait for such an interrupt, rather than periodically checking the state of the switch.

Physical Embodiment

The device embodying the present invention can be comprised of separate components, or may be completely self-contained in a single unit, or any combination thereof.

The electronic device detecting the switch state change may be physically separate from the electronic device that is the Sequencer as long as the two are electronically interfaced. For example, in one potential embodiment of the present invention, the switch and processor may be interfaced wirelessly. In another potential embodiment, the processor and target device may also be interfaced wirelessly.

Data Output

Data Set values may be output within the Processor and used internally and/or interfaced with additional circuitry to control other devices and components.

Potential embodiments of the present invention include, but are not limited to, those whose output comprises:

Numeric data values (non-MIDI)
Computer data and data sets
Control Voltages
Switching Arrays
Variable Resistances
Optical Output
Pulse-Width Modulation
Various Wireless Protocols While the Initial Commercial Embodiment is designed to control pitch shifting audio effects, the present invention may be used to control countless other effect parameters and types of devices, including, but not limited to oscillators, samplers, gain controls, switching networks, lighting rigs, electromechanical devices, software, robotics, and automation, to name only a few.

Data Storage

Various types of storage devices can be used to store Data Sets. Potential embodiments include, but are in no way limited to the following:

Computer Memory
A series of potentiometers
Control voltages
Switching arrays
Shift registers (digital and/or mechanical)
Optical media
Visual representations Programming Sequences One embodiment may not require a user to manually program Sequences using the device embodying the present invention, but might alternately allow the device embodying the present invention to be programmed by connecting it to an external device, such as a computer, which may then send Sequence Step data values to the device embodying the present invention.

The Initial Commercial Embodiment allows this type of external programming.

Transitions Between Steps

Potential embodiments of the present invention include the use of interim and/or interpolated values between Sequencer Steps to create transitions between the Steps. Such transitions may be linear, exponential, or calculated as a result of an algorithm. Such transitions may be programmable per Step, or follow pre-defined, or user-defined patterns and/or algorithms.

Non-Linear Sequence Advance

One potential embodiment of the present invention may not be limited to advancing a single Step upon each change of state of an electromechanical momentary switch, but may instead determine the number of Steps to skip based upon a mathematical formula or algorithm.

Data Merge

Potential future embodiments of the present invention include the ability to concurrently merge Sequencer Data Set values with existing data streams, and resolve timing conflicts with existing data streams by prioritizing the various types and/or sources of data.

CONCLUSIONS, RAMIFICATIONS, AND SCOPE

Thus the reader will see that at least one embodiment of the manually advanced Sequencer provides a far more efficient, intuitive, natural, and rhythmically flexible method of advancing a Sequencer, and requires 50% less motion while providing twice the speed of existing methods of manually advancing Sequencers using electromechanical momentary switches.

I claim:

1. A manually advanced sequencer comprising:

a. an electromechanical momentary switch, b. an electronic device capable of detecting each change of state in said electromechanical momentary switch, from open to closed and vice versa, and c. a sequencer whereby said electronic device will, upon detecting each change of state in said electromechanical momentary switch, trigger said sequencer to advance to a next step in a sequence and recall a data set associated with said step.

2. The manually advanced sequencer of claim 1, wherein said electromechanical momentary switch is in the form of a footswitch.

3. The manually advanced sequencer of claim 1, wherein said electromechanical momentary switch is interfaced wirelessly with said sequencer.

4. The manually advanced sequencer of claim 1, wherein the values in said data set are in the MIDI (Musical Instruments Digital Interface) format.

5. The manually advanced sequencer of claim 1, wherein the values in said data set are use to control one or more musical instruments.

6. The manually advanced sequencer of claim 1, wherein the values in said data set are use to control one or more audio effects.

7. The manually advanced sequencer of claim 1, wherein the values in said data set are use to control one or more audio signals.

8. The manually advanced sequencer of claim 1, wherein the values in said data set are use to control the pulse width of an electronic circuit.

9. The manually advanced sequencer of claim 1, wherein the values in said data set are used to generate corresponding control voltages.

10. The manually advanced sequencer of claim 1, wherein the values in said data set are used to generate corresponding electrical resistances.

11. The manually advanced sequencer of claim 1, wherein the values in said data set are used to control optical devices.

12. The manually advanced sequencer of claim 1, wherein the values in said data set are used to generate text.

13. The manually advanced sequencer of claim 1, wherein the values in said data set are used to generate visual images.

14. The manually advanced sequencer of claim 1, wherein the values in said data set are used to control computerized devices.

15. The manually advanced sequencer of claim 1, wherein the device embodying the present invention may be programmed by connecting it to an external device, such as a computer, which then sends sequence step data values to the device embodying the present invention.

16. The manually advanced sequencer of claim 1, wherein the device embodying the present invention uses interim and/or interpolated values between sequencer steps to create transitions between the steps.

17. The manually advanced sequencer of claim 1, wherein the device embodying the present invention is not limited to advancing a single step upon each change of state of said electromechanical momentary switch, but may instead determine the number of steps to skip based upon a mathematical formula or algorithm.

18. The manually advanced sequencer of claim 1, wherein the device embodying the present invention includes the ability to concurrently merge sequencer data set values with existing data streams, and resolve timing conflicts with existing data streams by prioritizing the various types and/or sources of data.

* * * * *